US012060712B2

(12) United States Patent
Hill

(10) Patent No.: US 12,060,712 B2
(45) **Date of Patent: *Aug. 13, 2024**

(54) STRUCTURAL POST WITH INTERNAL CONNECTOR SYSTEM

(71) Applicant: Fortress Iron, LP, Garland, TX (US)

(72) Inventor: Ian A. Hill, Plano, TX (US)

(73) Assignee: Fortress Iron, LP, Garland, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/896,657

(22) Filed: Aug. 26, 2022

(65) Prior Publication Data

US 2022/0403654 A1 Dec. 22, 2022

Related U.S. Application Data

(63) Continuation of application No. 17/075,276, filed on Oct. 20, 2020, now Pat. No. 11,428,005.

(51) Int. Cl.

| | |
|---|---|
| ***E04C 3/32*** | (2006.01) |
| ***E04H 12/08*** | (2006.01) |
| *E04F 10/00* | (2006.01) |

(52) U.S. Cl.

CPC ..... *E04C 3/32* (2013.01); *E04H 12/08* (2013.01); *E04F 10/005* (2013.01)

(58) Field of Classification Search

CPC ..... F16B 2200/403; F16B 7/18; F16B 9/054; F16B 9/056; E04B 1/2403; E04B 2001/2406; E04B 2001/2472; E04C 3/32; E04H 12/08; E04F 10/005

See application file for complete search history.

(56) References Cited

U.S. PATENT DOCUMENTS 3,500,595 A 3/1970 Bennett
3,633,862 A * 1/1972 Breen ..... F16B 9/052 256/65.16

(Continued)

FOREIGN PATENT DOCUMENTS

CN 105923095 A 9/2016
EP 1 050 244 A2 11/2000

OTHER PUBLICATIONS

Eva-Last, Alcotrus Aluminum Architectural Framework: Hybrid Architectural System, Jan. 9, 2019, retrieved from www.eva-last.com on Jun. 9, 2020, 8 pgs.

(Continued)

*Primary Examiner* — Brian E Glessner
*Assistant Examiner* — Daniel J Kenny
(74) *Attorney, Agent, or Firm* — Foley & Lardner LLP; John J. May

(57) ABSTRACT

A structural post includes a base plate defining a plurality of through holes, and a post portion that includes at least a pair of internal walls and at least a pair of external walls. A connector block is configured to receive a locking screw and to engage with a bolt thread of a bolt. A lock plate has a plate thread that is configured to engage the screw thread of the locking screw, and the lock plate is configured to expand upon being drawn by the locking screw into tight engagement with the connector block. The expanded lock plate is configured to apply a force on one of the pair of internal walls and one of the pair of external walls.

20 Claims, 6 Drawing Sheets

(56) References Cited

U.S. PATENT DOCUMENTS 3,864,051 A * 2/1975 Reid ..... F16B 7/0446 411/180
3,890,022 A 6/1975 Moon
4,091,593 A 5/1978 Mennuto
4,346,872 A * 8/1982 Tornya ..... E04F 11/181 256/65.02
4,793,111 A * 12/1988 Shewchuk ..... F21V 21/10 52/298
4,802,785 A * 2/1989 Richards ..... F16B 7/0413 248/343
4,810,144 A * 3/1989 Martelli ..... F16B 9/056 29/523
4,890,954 A * 1/1990 Richards ..... F21V 21/03 403/372
5,184,922 A * 2/1993 Blackwell ..... F16B 13/06 411/33
5,193,786 A * 3/1993 Guenther ..... E04F 11/18 256/65.16
5,267,806 A * 12/1993 Bock ..... F16B 7/0446 403/260
5,503,492 A * 4/1996 Stevens ..... F16B 7/0413 411/510
5,605,075 A 2/1997 Chi
5,810,380 A * 9/1998 Lin ..... B62K 21/18 403/370
5,971,415 A * 10/1999 Lin ..... B62K 21/06 280/280
6,088,877 A * 7/2000 Swy ..... A47C 7/002 16/42 T
6,238,156 B1 * 5/2001 Leibman ..... F16B 9/056 403/280
6,988,700 B2 * 1/2006 Cote ..... E04H 12/2269 248/519
7,543,802 B2 * 6/2009 Petta ..... E04F 11/1814 256/65.03
7,677,000 B2 * 3/2010 Walker ..... E04F 11/1812 248/539
7,815,206 B2 10/2010 Tseng
7,992,362 B2 * 8/2011 Petta ..... E04C 3/30 52/855
8,291,678 B2 * 10/2012 William ..... E04H 1/1272 403/337
8,621,710 B2 * 1/2014 Carpinella ..... A47B 91/06 16/42 T
8,979,452 B2 * 3/2015 Ikuno ..... F16B 31/021 411/55
9,004,439 B2 * 4/2015 Gross ..... E04H 12/2269 248/507
10,309,091 B2 * 6/2019 McNamee ..... E04F 11/1817
10,385,898 B2 * 8/2019 Pourtier ..... F16B 13/065
10,625,329 B2 * 4/2020 Avetsisiants ..... B21D 39/044
11,002,013 B1 * 5/2021 Herron, III ..... E04C 3/32
11,098,739 B2 * 8/2021 Struhl ..... F16B 9/07
2003/0052460 A1 3/2003 Choy
2007/0041806 A1 * 2/2007 Wahls ..... B60N 2/24 411/166
2010/0229989 A1 9/2010 Coscarella
2011/0318134 A1 * 12/2011 Ikuno ..... F16B 13/068 411/49
2012/0125870 A1 5/2012 Decroos et al.
2012/0263553 A1 * 10/2012 Greenfield ..... F16B 5/0275 411/55
2014/0093306 A1 * 4/2014 Imai ..... E04B 1/4157 403/180
2016/0258161 A1 9/2016 Imai et al.
2018/0073256 A1 3/2018 Lutes

OTHER PUBLICATIONS

International Search Report and Written Opinion on PCT PCT/US2021/055139 dated Jan. 19, 2022.
International Search Report and Written Opinion on PCT PCT/US2021/055144 DTD Feb. 23, 2022.

* cited by examiner

STRUCTURAL POST WITH INTERNAL CONNECTOR SYSTEM

PRIORITY CLAIM

This application is a continuation of U.S. patent application Ser. No. 17/075,276, filed on Oct. 20, 2020, the disclosure of which is hereby incorporated by reference.

CROSS-REFERENCE TO RELATED PATENT APPLICATIONS

This application is subject matter related to U.S. patent application Ser. No. 17/075,263, filed on Oct. 20, 2020, entitled "Internal Connector System for Structural Members," invented by the inventor named in this application, the disclosure of which is hereby incorporated by reference.

BACKGROUND

The present invention relates generally to the field of architectural construction, and more specifically to architectural construction of certain structures using alternative building materials, such as extruded structural members. Such building materials are particularly useful in construction of outdoor living structures, such as pergolas, gazebos, arbors, pavilions, and the like. Conventional fasteners were not designed to work with alternative building materials. A fastening system that takes advantage of features of extruded structural members would be useful.

SUMMARY OF THE INVENTION

One embodiment of the invention relates to a structural post that includes a base plate defining a plurality of through holes, and a post portion that includes at least a pair of internal walls and at least a pair of external walls. A connector block is configured to receive a locking screw and to engage with a bolt thread of a bolt. A lock plate has a plate thread that is configured to engage the screw thread of the locking screw, and the lock plate is configured to expand upon being drawn by the locking screw into tight engagement with the connector block. The expanded lock plate is configured to apply a force on one of the pair of internal walls and one of the pair of external walls.

A technical advantage of an embodiment of the present disclosure includes a structural post that is easily assembled with connectors that are internal to the post and hidden from view. The structural post and the connector systems may be manufactured with extruded metal parts, for example extruded aluminum parts. The post portions may be formed of alternative building materials that generally eliminate and/or significantly reduce the amount of natural wood used in certain construction projects. For example, the disclosed structural posts may be extruded metal parts that have an outer shell providing the appearance of natural timber. The extrusions provide channels to hold the internal connector system that would not be present in natural wood often used in the construction of outdoor living spaces. This summary is illustrative only and is not intended to be in any way limiting.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Figure 1A:
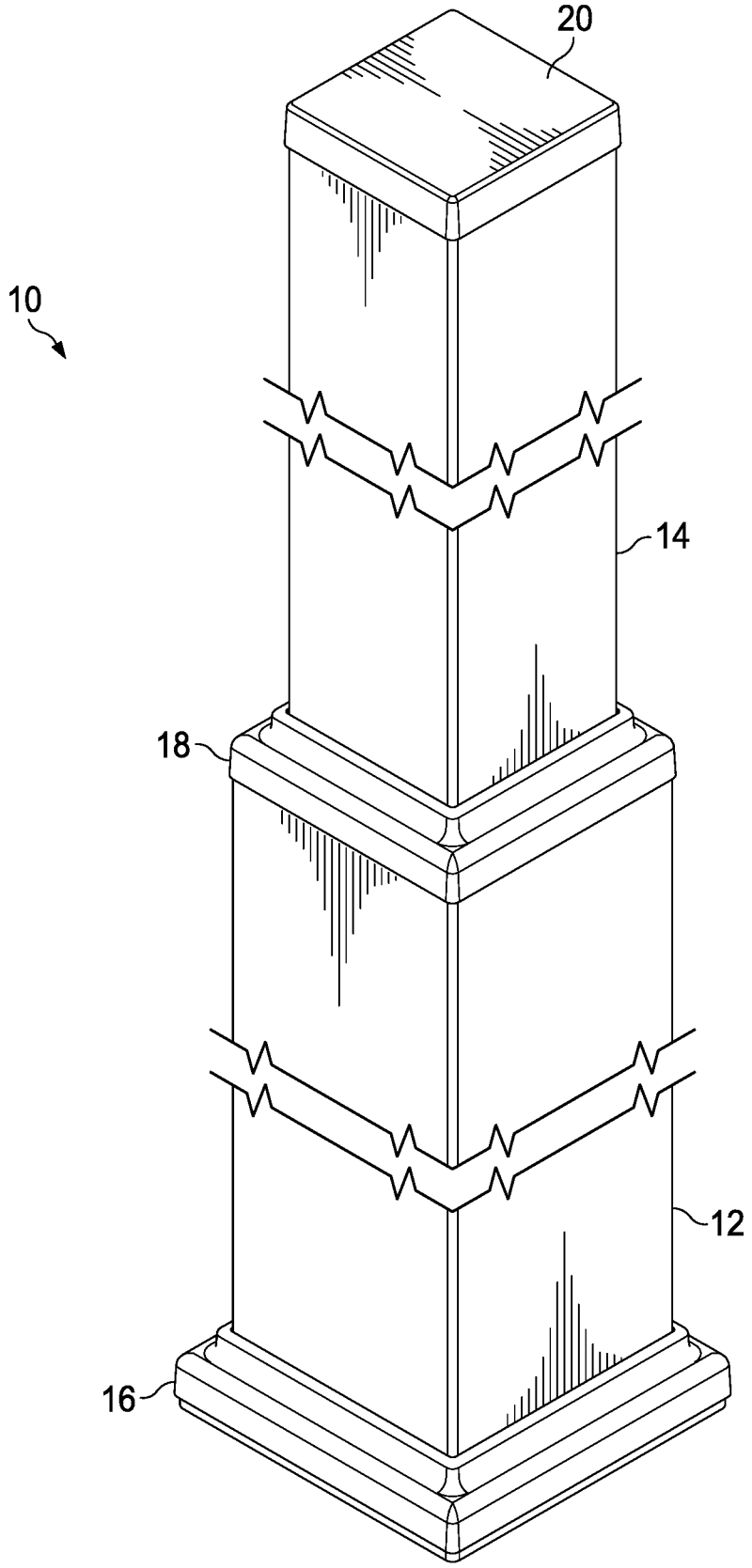
FIG. 1A is a perspective view of an embodiment of a structural post employing an internal connector system according to the teachings of the present disclosure.

FIG. 1A is a perspective view of a structural post 10. The structural post 10 may be tiered, and may include any suitable number of post portions, each functioning as a structural post and the combined post portions functioning as a tiered structural post 10. For example, the structural post 10 may include two tiers referred to herein as a lower post portion 12 and an upper post portion 14. Alternative embodiments may include a third or fourth post portion tiered as shown in FIG. 1A. This disclosure contemplates more than three post portions making up a structural post 10. Also, the structural post 10 may include only a single tier. In an embodiment of the structural post 10 with only one post portion, the post portion may be secured to a base plate using the disclosed internal connector system.

The structural post 10 may be used to support an overhanging structure. Examples of an overhanging structures that may be supported by the structural post 10 include gazebos, arbors, pavilions, pergolas, and the like. According to one embodiment, a structural post 10 may be positioned at each of four corners of a pergola formed with alternative building materials such as aluminum extruded structural members.

A pergola constructed with four of the structural posts 10 may be sold as a kit to allow the purchaser to construct the pergola using the internal connector system disclosed. The pergola kit may include four disassembled structural posts 10 to be disposed at each corner of the pergola. Each structural post 10 may be connected to a pair of perimeter beams. Four perimeter beams form the perimeter of the pergola and are held up by the structural posts 10. The perimeter beams may be connected to the structural posts 10 using an internal connector system that hides all of the fasteners within the structural members (i.e. posts and beams). For example, the perimeter beams may be connected to the upper post portion 14 using the internal connector system shown and described in co-pending U.S.

patent application with number 670683-1046, entitled "Internal Connector for Structural Members," invented by Ian Hill, and filed concurrently herewith.

The structural post 10 may include one or more skirts, for example a base skirt 16 and an upper post skirt 18. The base skirt 16 and the upper post skirt 18 may be substantially identical with the exception that the base post skirt 16 is larger in size than the upper post skirt 18. An isometric view of a base skirt 16 (or an upper skirt 18) is shown in FIG. 1D. The upper post portion 14 may be covered by a post cap 20. Each of the base skirt 16, the upper skirt 18, and the post cap 20 may be a thin-walled polymeric part. According to certain embodiments, each of the base skirt 16, the upper skirt 18, and the post cap 20 may be formed by injection molding or other suitable polymeric fabrication process.

Figure 1B:
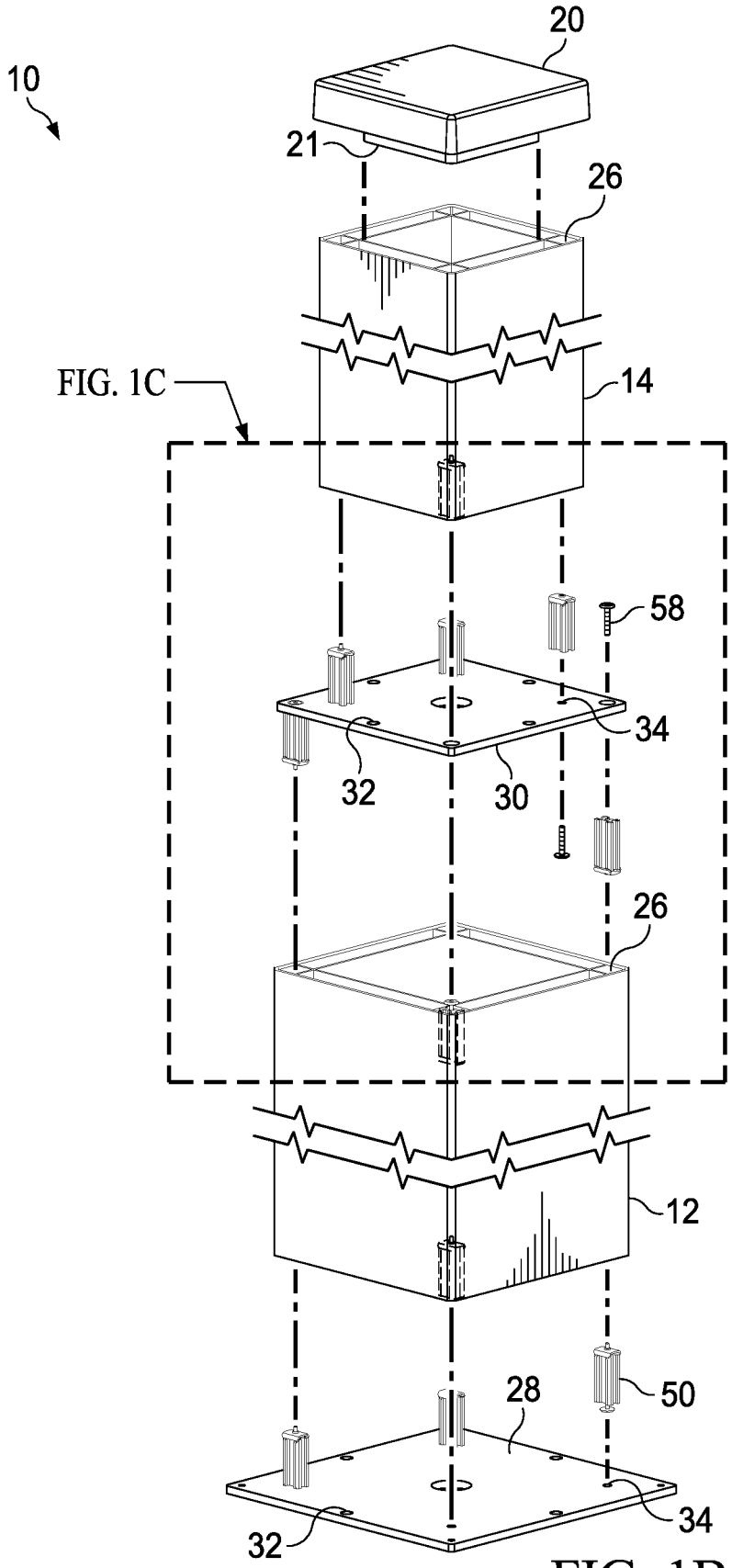
FIG. 1B is a perspective, exploded view of the structural post of FIG. 1A.
Figure 1C:
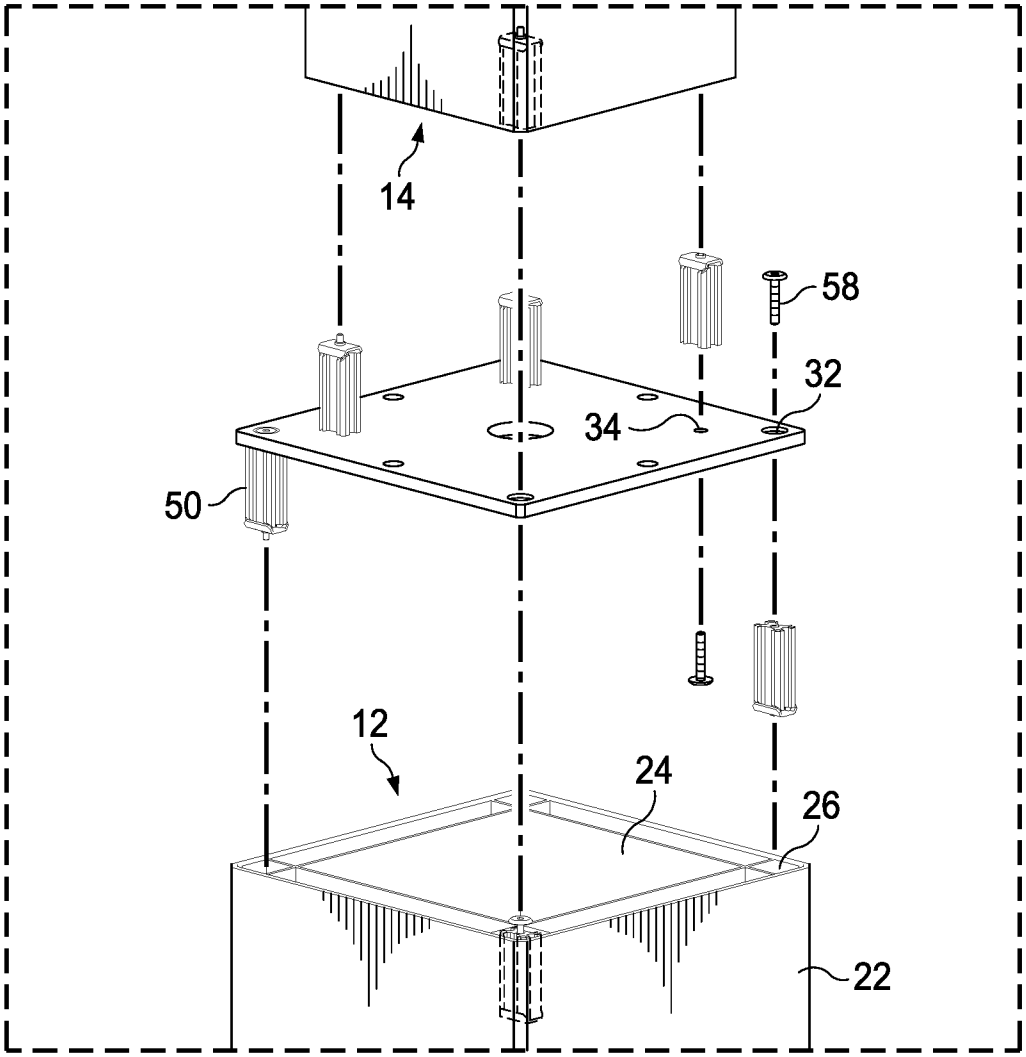
FIG. 1C is a perspective, detail view of the exploded view of FIG. 1B.
Figure 1D:
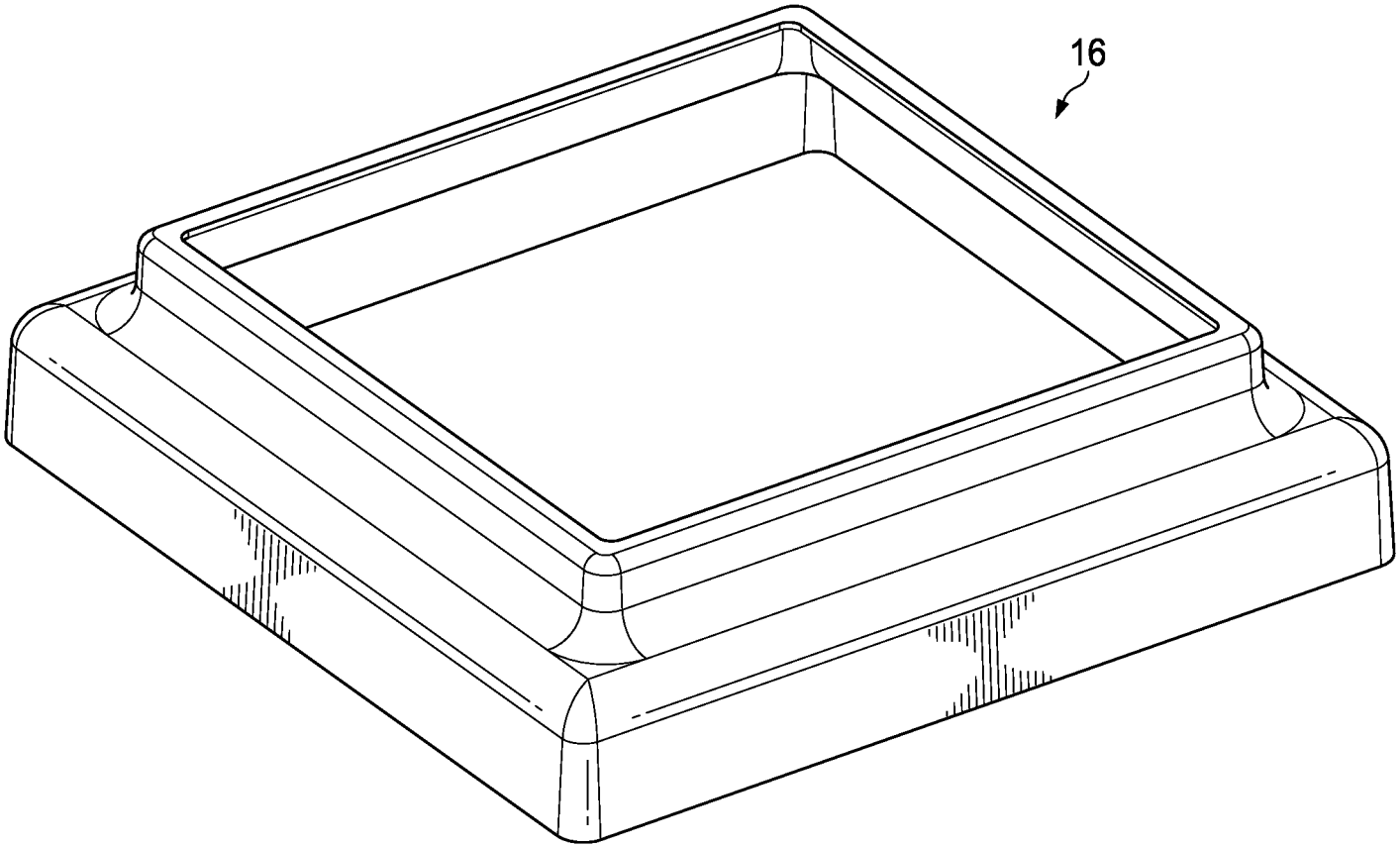
FIG. 1D is a perspective view of a skirt shown in FIG. 1A.

WM FIG. 1B is an exploded, perspective view of the structural post 10 shown in FIG. 1A, without the skirts 16, 18 and FIG. 1C is a detail view of a portion of FIG. 1B. The lower post portion 12 and the upper post portion 14 may be any suitable length as indicated by the break lines shown in the illustrations. According to an embodiment, the lower post portion 12 may have a length in a range of six to sixteen feet, for example eight feet. Similar to traditional lumber the lower post portion 12 and the upper post portion 14 may be extruded and cut to a specific length before being assembled in a kit. Alternatively, the upper post portion 14 and the lower post portion 12 may be extruded or otherwise formed to have a particular length and may be cut to the desired size by the user. The post portions 12, 14 may be any extrudable length.

Each of the lower post portion 12 and the upper post portion 14 of the structural post 10 is a hollow structure formed by external walls 22 and internal walls 24. Each of the lower post portion 12 and the upper post portion 14 may be identical with the exception of the size, (i.e. the length and the cross-sectional area), so the description of the lower post portion 12 applies to the upper post portion 14, unless otherwise indicated. According to certain embodiments, the lower post portion 12 of the structural post 10 may be formed of a composite material that includes an extruded metal core, for example an extruded aluminum core. The external walls 22 and the internal walls 24 may be formed by extruding a metallic material, such as aluminum. An extrusion die may be sized and shaped to simultaneously form the external walls 22 and the internal walls 24.

The external walls 22 may include a composite material that is co-extruded, glued, or otherwise applied to the external metal wall to give the structural post 10 an appearance of a wooden structure. The external walls 22 may be formed of a combination of the extruded aluminum and a cap of a wood-particle/polymer composite material that may be co-extruded with an engineered flexible adhesive to form the outer shell giving the appearance of natural timber. The internal walls 24 provide rigidity to the structural post 10. According to an embodiment, the internal walls 24 are spaced apart and parallel to the external walls 22 and run the length of the lower post portion 12 (or the upper post portion 14). A corner channel 26 is formed proximate each of the four corners of the lower post portion 12. The corner channel 26 is formed by two adjacent external walls 22 and two adjacent internal walls 24, and the corner channel 26 runs the length of the lower post portion 12.

The lower post portion 12 may be any suitable size in cross-section, for example the lower post portion 12 may be sized similarly to conventional wooden structural members. The lower post portion 12 may have a cross-sectional area common to lumber identified as 8"×8" or 6"×6" or 4"×4". According to one embodiment, the lower post portion 12 may have a cross-sectional area that is sized to imitate cuts of lumber that are identified as 8"×8" square post. The upper post portion 14 may have a cross-sectional area that is sized to imitate cuts of lumber that are identified as a 6"×6" square post. According to an alternate embodiment, the lower post portion 12 may have a cross-sectional area that is sized to imitate cuts of lumber that are identified as 6"×6" square post. The upper post portion 14 may have a cross-sectional area that is sized to imitate cuts of lumber that are identified as a 4"×4" square post.

Although the upper post portion 14 and the lower post portion 12 are each shown with square cross-sections in the figures, this disclosure contemplates a variety of cross-sectional shapes for the structural members including circular. In an embodiment with post portions with a circular cross-section, the internal channels may have a square or rectangular cross-section to correspond with the locking features of the disclosed internal connector system. Also, according to an alternate embodiment, either one of or both the lower post portion 12 and the upper post portion 14 may be formed of a polymeric material that may be formed by extrusion or other polymeric forming process.

With reference to FIG. 1B, the structural post 10 includes a base plate 28 and an upper plate 30. Each of the base plate 28 and the upper plate 30 may be referred to as a connector plate. The base plate 28 may be anchored to the ground or other foundation using any suitable fastener. The base plate 28 and the upper plate 30 may be identical with the exception of their respective sizes, so the description of the base plate 28 applies to the upper plate 30, unless otherwise indicated. The base plate 28 includes a plurality of spaced apart perimeter through holes 32. The perimeter through holes 32 are located at each of the corners of the base plate 28. Additional perimeter through holes 32 may be located at a midpoint of each of the sides of the base plate 28. The perimeter through holes 32 provide a through hole to receive a fastener to anchor the base plate 28 two a foundation. The fastener may be any suitable fastener and the through holes may have a diameter corresponding to a particular fastener.

The base plate 28 also includes a plurality of inner through holes 34. The inner through holes are positioned proximate each of the four corners of the base plate 28. The inner through holes 34 are positioned to align with the corner channels 26 when the lower post portion 12 is positioned on the base plate 28. The perimeter through holes 32 are positioned to be outside of the footprint of the lower post portion 12. The base plate 28 may be formed of any suitable sheet metal, for example steel. The inner through holes 34 may be countersunk on one side to receive a head of a bolt such that the bolt head is flush with the surface of the base plate 28.

The upper plate 30 may be sized smaller than the base plate 28. The upper plate 30 includes a plurality of perimeter through holes 32 that are disposed spaced apart around the perimeter of the upper plate 30, similar to that shown and described above with respect to the base plate 28. The perimeter through holes 32 are located to align with the corner channels of the lower post portion 12. The perimeter through holes 32 may be countersunk on one side to receive a bolt head and position the bolt head to be flush with the upper plate 30.

The upper plate 30 also includes a plurality of inner through holes 34 located to be aligned with the corner channels 26 of the upper post portion 14. The perimeter through holes 32 are disposed to be outside the footprint of the upper post portion 14. The fasteners and the perimeter through holes 32 are covered by the upper skirt 18, as shown in FIG. 1A.

The structural post 10 may be assembled by attaching the base plate 28 to the lower post portion 12 using the using an internal connector system 50 that is received in a corner channel 26 of the lower post portion 12. As described in further detail below, the internal connector system 50 is secured in the corner channel 26 and provides a threaded bore to receive a fastener. In this manner, the base plate 28 is connected to the lower post portion 12. A plurality of the perimeter through holes 32 each receives a suitable fastener to anchor the base plate 28 and the lower post portion 12 to a foundation to secure the structural post 10 upright. The structural post 10 may include the lower post portion 12 and the base plate 28, with the upper post portion 14 being omitted.

Figure 2:
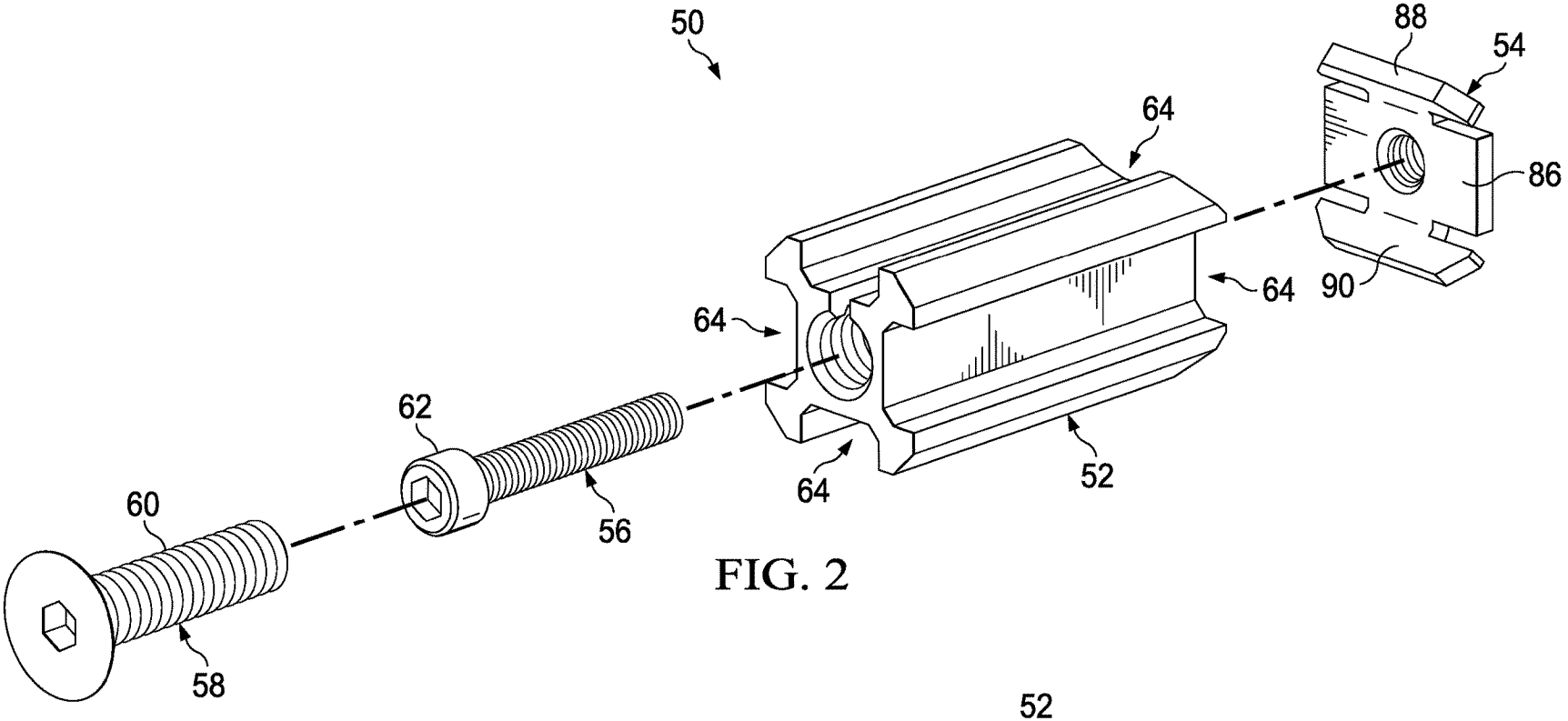
FIG. 2 is a perspective, exploded view of an internal connector system employed to join certain components of the structural post according to an embodiment of the present disclosure.

FIG. 2 is an exploded, perspective view of an internal connector system 50 shown in FIGS. 1B and 1C. The internal connector system 50 includes a connector block 52 and a lock plate 54. The lock plate 54 is coupled to the connector block 52 by a locking screw 56. Tightening the locking screw 56 draws the lock plate 54 toward the connector block 52 and expands the lock plate 54 such that it impinges on an external wall 22 and an internal wall 24 of the corner channel 26 of the lower post portion 12 or upper post portion 14. More specifically, the first wing 88 and the second wing 90 of the lock plate 54 are bent (i.e. elastically deformed) by the connector block 52. The wings 88, 90 are bent to increase an angle the respective wing 88 forms with a body 86 of the lock plate 54. The expansion of the lock plate 54 causes the wings 88, 90 to impinge on the walls of the corner channel 26 and secures the lock plate 54 and the connector block 52 within the corner channel 26. The connector block 52 may then receive a bolt 58, which secures the base plate 28 to the lower post portion 12. The same connector block 52 and lock plate 54, or a differently sized connector block 52 and lock plate 54, may be used to secure the upper plate 30 to the upper post portion 14.

For example, a connector block 52 may be received in a corner channel 26 of the lower post portion 12, and the locking screw 56 may be tightened such that the lock plate 54 impinges on an internal wall 24 and an external wall 22 and thereby secures the lock plate 54 and connector block 52 assembly within the channel 26. A bolt 58 is received through an inner through hole 34 in the base plate 28 and threaded into the connector block 52. In this manner, the internal connector system 50 including the bolt 58 is disposed underneath the base plate 28 or within the lower post portion 12 (or the upper post portion 14) and hidden from view.

Figure 3:
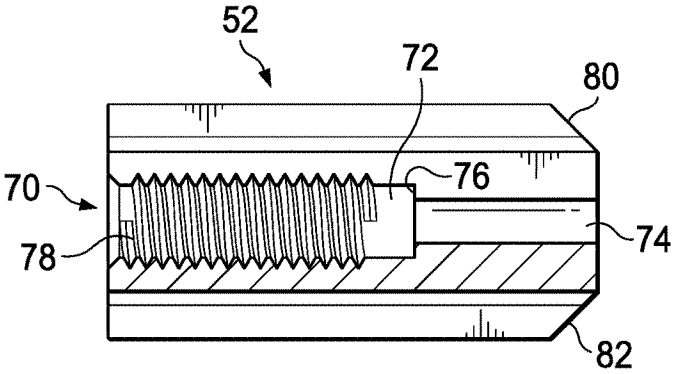
FIG. 3 is a cross section of a connector block of the internal connector system shown in FIG. 2.

With continuing reference to FIG. 2, reference is made to FIG. 3, which a cross-section of the connector block 52. The connector block 52 may be a generally block shaped member with features formed therein. According to an embodiment, the connector block 52 may be formed by extrusion of a metal or polymeric material. For example, the connector block 52 may be an extruded aluminum block that is cut to the size shown from a larger length blank extrusion. The extrusion die may include features that form voids and/or through holes in the connector block 52. The voids and/or through holes may be further formed by secondary operations, for example an additional bore and a thread may be machined or otherwise formed in one or more of the through holes that are first formed by extrusion. A polymeric connector block 52 may be employed in applications where the internal connector system 50 must withstand a lighter load, for example in non-architectural applications.

The connector block 52 includes a center through hole 70. The center through hole 70 functions as a blank through bore to allow the locking screw 56 to be received through the center through hole 70 and be threaded to a corresponding threaded through hole 92 in the lock plate 54. A semi-blind bore 72 is formed in a subsequent operation to the initial extrusion. The semi-blind bore 72 has a diameter that is larger than a through portion 74 of the center through hole 70. As such, an internal shoulder 76 is formed internal to the connector block 52. An internal thread 78 is formed in the wall of the semi-blind bore 72. The internal thread 78 is configured to engage the thread 60 of the bolt 58.

The thickness of the connector block 52 and the length of the locking screw 56 is such that the head 62 of the locking screw 56 seats on the internal shoulder 76. Turning the seated locking screw 56 draws in the lock plate 54 and increases tight engagement between the lock plate 54 and the connector block 52. This engagement expands the lock plate 54 and causes the wings 88, 90 to impinge on the walls of the corner channel 26 of the lower post portion 12 (or the upper post portion 14) and thereby secures the connector block 52 and lock plate 54 assembly within the corner channel 26.

The lower post portion 12 and the upper post portion 14 are connected by eight internal connector systems 50 and the upper plate 30. More specifically, the thread 60 of the bolt 58 is received in threaded engagement with the internal thread 78 of the semi-blind bore 72 of the connector block 52. The length of the connector block 52 allows sufficient material for the head 62 of the locking screw 56 and the shaft of the bolt 58 to be disposed in the same semi-blind bore 72.

With continuing reference to FIG. 3, the cross-section of the connector block 52 shows a first chamfer 80 and a second chamfer 82. The angle of both the first chamfer 80 and the second chamfer 82 correspond to angles of between the wings 88, 90 and a body 86 of the lock plate 54 when the lock plate 54 is expanded by the connector block 52. According to one embodiment, an angle of the first chamfer 80 and an angle of the second chamfer 82 may each be in a range of 40-50 degrees, for example 45 degrees. According to an alternate embodiment, one or both of the chamfers 80, 82 may be omitted. In this embodiment, the lock plate 54 expands upon being drawn into tight engagement with the rear portion of the connector block 52, and the portions of the connector block 52 that contact the wings 88, 90 cause the lock plate 54 to expand.

The connector block 52 may include one or more perimeter voids 64, as shown in FIG. 2, to provide a unique shape to the connector block 52, and the perimeter voids 64 also allow less material, i.e. aluminum, to be used to extrude the connector block 52. Alternatively, the connector block 52 may be formed without the perimeter voids or with differently shaped perimeter voids.

According to certain embodiments, the center through hole 70 may not have material completely surrounding it, as shown in FIG. 2. The incomplete center through holes 70 allows the majority of the wall of the center through hole 70 to be formed by the extrusion process such that the center through hole 70 can perform the function of holding a threaded connector, such as holding the bolt 58 in threaded engagement and receiving the locking screw 56 to seat on the internal shoulder 76. As such, manufacturing efficiency is facilitated because a secondary drilling operation is not necessary to form the through holes from an extruded blank. According to an alternate embodiment, the connector block 52 may be machined from a billet of metal, and the center through hole 70 may be drilled through the block 52. In this embodiment, the wall of the center through hole 70 may completely surround the center through hole 70.

Figure 4A:
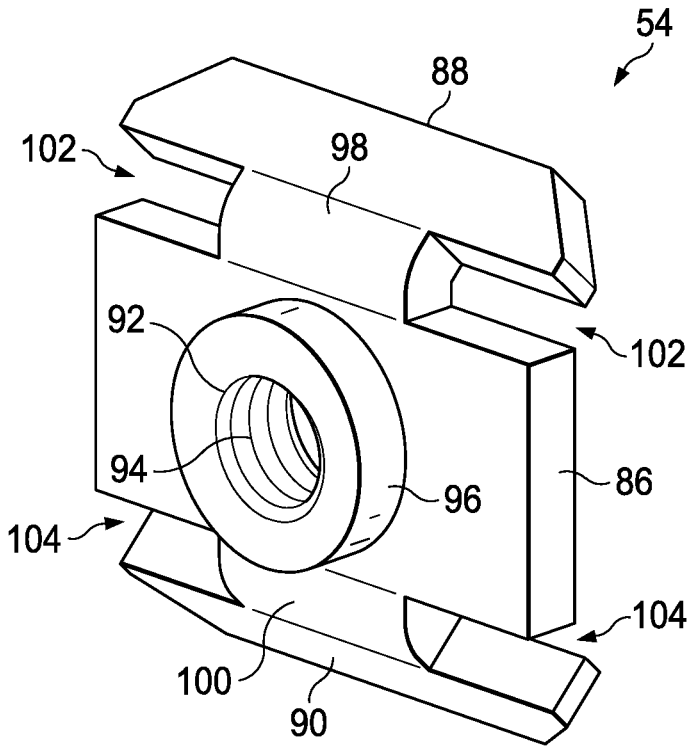
FIGS. 4A and 4B are perspective and elevation views, respectively of a lock plate of the internal connector system shown in FIG. 2.
Figure 4B:
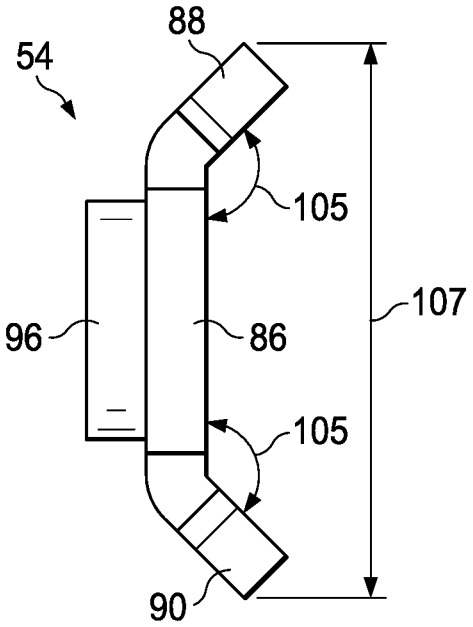

Reference is made to FIGS. 4A and 4B, which show a perspective view and a side view respectively of the lock plate 54. The lock plate 54 includes a body 86, a first wing 88 extending from the body 86, and a second wing 90 extending from the body 86. The lock plate 54 may be formed of a rigid metal, for example stainless steel. According to one embodiment, the lock plate is formed of cold rolled steel with a thickness of approximately 0.08 inches. According to an alternate embodiment, the lock plate 54 may be formed of a polymeric material that may be formed by extrusion or other polymeric forming process. A polymeric lock plate 54 may be employed in applications where the internal connector system 50 must withstand a lighter load, for example in non-architectural applications.

The body 86 of the lock plate 54 is a generally flat and straight wall that defines a center through hole 92. The center through hole is disposed to align with the center through hole 70 of the connector block 52. The center through hole 92 includes a thread 94 that is configured to engage with the thread of the locking screw 56. According to an embodiment, an annular boss 96 extends from the body 86 and provides additional material to allow for secure engagement of the locking screw 56 and the threaded center hole 92 of the lock plate 54.

An upper bend 98 is disposed at the junction of the body 86 and the first wing 88. A lower bend 100 is disposed at the junction of the body 86 and the second wing 90. The bends 98 and 100 allow the wings 88, 90 to extend from the body 86 at a non-perpendicular angle. According to one embodiment, the first wing 88 is formed by bending a flat plate to form the shape shown in FIGS. 4A and 4B. An upper portion of the flat plate may be bent approximately 65 degrees downward away from the annular boss 96. Similarly, the second wing 90 may be formed by bending a lower portion of the flat plate disposed opposite the upper portion approximately 65 degrees upward, toward the first wing 88 and away from the annular boss 96. A wing angle 105 in the relaxed state may be in a range of 100-125 degrees, for example approximately 115 degrees. Similarly, a height 107 of the lock plate 54 in a relaxed state may be in a range of 0.4-1.3 inches, for example approximately two-thirds of an inch.

Figure 4C:
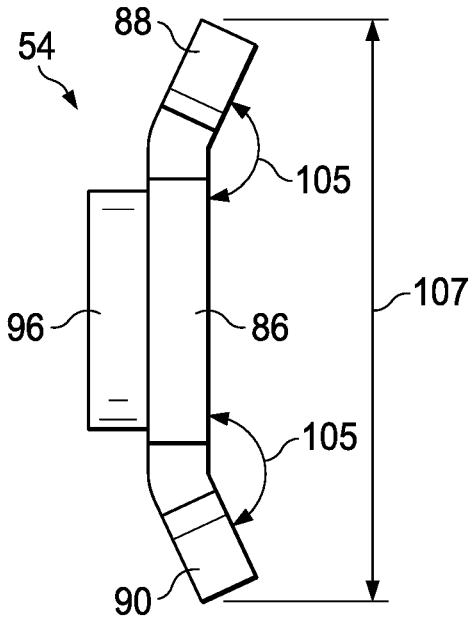
FIG. 4C is an elevation view of the lock plate of FIGS. 4A and 4B in an expanded configuration.

In operation, the locking screw 56 is turned to draw the lock plate 54 toward the connector block 52. The wings 88, 90 are forced by the chamfers 80, 82 of the connector block 52 to bend toward the annular boss 96, and thereby increase the height 107 of the lock plate 54 and the wing angle 105. The expansion of the height of the lock plate 54 causes the lock plate 54 to impinge and be secured to an external wall 22 and an internal wall 24 forming the corner channel 26. FIG. 4C shows the lock plate 54 in an expanded configuration. The wing angle 105 is increased to approximately 135 degrees, and the height 107 is increased approximately 7% to approximately 0.73 inches. As discussed above, the change in wing angle 105 and height 107 is determined at least in part by the chamfer angle of the connector block 52.

According to an embodiment, an upper void 102 is formed on each side proximate the upper bend 98, and a lower void 104 is formed on each side proximate the lower bend 100. The upper void 102 and the lower void 104 facilitate expansion of the lock plate 54 by the connector block 52, and an increase in the wing angle 105 and the height 107. The upper void 102 facilitates elastic bending of the first wing 88 to open the wing angle 105 between the body 86 and the first wing 88. The lower void facilitates elastic bending of the second wing 90 to open the wing angle 105 between the body 86 and the second wing 90. The upper voids 102 and the lower voids 104 permit the expanding function of the lock plate 54 when the lock plate 54 is formed of a material having a thickness that would otherwise not expand or would not expand sufficiently to impinge on the walls of the corner channel 26.

In the relaxed state, the locking screw 56 may be in threaded engagement with the threaded center through hole 92 of the lock plate 54, but the locking screw 56 is not tightened to elastically bend and expand the wings 88, 90 of the lock plate 54. Tightening the locking screw 56 draws the lock plate 54 in tight engagement with the connector block 52, and the connector block 52, more specifically the chamfers 80, 82 of the connector block 52, apply a force to each of the wings 88, 90 of the lock plate 54 and cause elastic deformation of the lock plate 54 in a manner that the wing angle 105 between the body 86 and the wings 88, 90 increases, which causes the overall height 107 of the lock plate to increase. According to one embodiment, the height of the lock plate increases by approximately 7%, but increases in a range of 5% to 15% are contemplated by this disclosure. This increase in height 107 applies a frictional force to the walls forming the corner channel 26 of the lower post portion 12 or the upper post portion 14 and holds the connector block 52 and lock plate 54 assembly securely within the corner channel 26.

With reference to FIGS. 1A-1C, a user (i.e. contractor, homeowner, business owner, and the like that desires a structural improvement to an outdoor living space) may assemble a structural post 10 using the internal connector system 50. The user may insert a loosely assembled connector block 52, lock plate 54, and locking screw 56 into a corner channel 26 at a lower end of the lower post portion 12. At the appropriate depth within the corner channel 26 the, the user may tighten the locking screw 56. Tightening the locking screw 56 draws the lock plate 54 in tight engagement with the connector block 52, and the connector block 52 expands the lock plate 54. The expanded lock plate 54 has first wing 88 and second wing 90 that impinge on an external wall 22 and an internal wall 24. This expansion creates a frictional force on the walls, which holds the assembly of the connector block 52 and the lock plate 54 within the corner channel 26. This procedure is repeated for each of the four lower corners of the lower post portion 12. A user may want to perform the same assembly of the internal connector system with the corner channels 26 at the four corners of the upper and opposite end of the lower post portion 12. In this manner, the user secures the internal connector systems 50 within the corner channels while the lower post portion 12 is disposed in a horizontal position. Thus, the internal connector system 50 may be positioned without being dropped through the corner channel 26, which may be difficult for the user to reach.

The base plate 28 is secured to the lower post portion 12 by threading the bolt through the inner through holes 34 in the base plate 28 into each of the connector blocks 52 disposed in the corner channels 26. The locking screw 56 is already positioned in the center through hole 70 and seated on the internal shoulder 76. The head of the bolt 58 may be received in a countersunk hole on the underside of the base plate 28.

The upper plate 30 is secured to the upper post portion 14 using the internal connector system 50. Each of four internal connector systems are secured into a respective corner channel 26 of the upper post portion 14. More specifically, an internal connector system 50 is secured in the lower corner channels 26 of the upper post portion 14. Similarly to the lower post portion 12, the internal connector systems 50 may be secured within the corner channels 26 of the upper post portion 14 while the upper post portion 14 is in a horizontal orientation. In this manner, the internal connector system 50 can be positioned at an appropriate depth within the corner channels 26 without the internal connector system 50 falling through the corner channels 26. When the internal connector system 50 is positioned at the proper depth within the corner channels 26 of the upper post portion 14, the locking screw 56 is tightened to draw the lock plate 54 into tight engagement with the connector block 52 and expand the lock plate 54. The first wing 88 and the second wing 90 of the expanded lock plate 54 impinge on the internal wall 24 and the external wall 22 of the corner channel 26. The frictional forces between the first wing 88 and the internal wall 24 or external wall 22 and the frictional forces between the expanded second wing 90 and the internal wall 24 or the external wall 22 hold the connector block 52 in position within the corner channel 26 to allow it to receive the bolt 58.

The upper plate 30 is positioned such that the inner through holes 34 align with the center through holes 70 of the connector blocks 52. The bolt 58 is received through the inner through holes 34 and in threaded engagement with the internal thread 78 of the connector block 52, and thereby the upper plate 30 is secured to the upper post portion 14.

The assembly of the upper post portion 14 and the upper plate 30 is then positioned on the upper end of the lower post portion 12, such that the perimeter through holes 32 align with the center through hole 70 of the connector blocks 52 that were previously positioned in the corner channels 26 of the lower post portion 12. The bolt 58 is received through the perimeter through holes 32 and secured in threaded engagement with the internal thread 78 of the connector block 52. The head of the bolt 58 may be received in a countersunk perimeter through hole 32, such that the head of the bolt 58 is flush with the surface of the upper plate 30.

As shown in FIG. 1A, the base skirt 16 may be received over the lower post portion 12. Thus, the base skirt 16 may be positioned at the base of the lower post portion 12 to cover the perimeter portion of the base plate 28 and the anchor fasteners received through the perimeter through holes 32 in the base plate 28. The upper post skirt 18 may be received over the upper post portion 14 and positioned at the lower end of the upper post portion 14, such that the upper skirt 18 covers the portion of the upper plate 30 that extends beyond the footprint of the upper post portion 14. The base skirt 16 and the upper skirt 18 may be secured in the positions illustrated in FIG. 1A using an adhesive.

With reference to FIG. 1B, a post cap 20 may be received within the hollow portion of the upper post portion 14. For example, a skirt portion 21 of the post cap 20 extends from the underside of the post cap 20. The skirt portion 21 is sized and shaped to be received in friction fit with the inner surface of the internal walls 24. The post cap 20 is substantially the same size as the upper post portion 14. The skirt portion 21 may be secured within the hollow opening of the upper post portion 14 using an adhesive.

As utilized herein with respect to numerical ranges, the terms "approximately," "about," "substantially," and similar terms generally mean +/−10% of the disclosed values. When the terms "approximately," "about," "substantially," and similar terms are applied to a structural feature (e.g., to describe its shape, size, orientation, direction, etc.), these terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the structural post with internal connector system as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A connector system for structural members, comprising:

a plurality of locking screws each comprising a screw thread;

a plurality of connector blocks each comprising a plurality of bore holes each sized and shaped to receive a respective locking screw, each connector block configured to engage with a bolt thread of a bolt;

a plurality of lock plates each having a plate thread configured to engage the screw thread of the respective locking screw, each lock plate being configured to expand upon being drawn by the respective locking screw into tight engagement with a respective connector block;

wherein each expanded lock plate is configured to apply a force to at least one internal wall of a structural member; and a connector plate supporting the plurality of connector blocks.

2. The connector system of claim 1 wherein each bore hole is sized and shaped to receive a head of the respective locking screw and a portion of each bore hole is threaded.

3. The connector system of claim 2 wherein the threaded portion of each bore hole is configured to engage the bolt thread of the respective bolt.

4. The connector system of claim 1 wherein each bolt is received through one of the plurality of through holes in the connector plate.

5. The connector system of claim 1 wherein each lock plate comprises a first wing forming a first wing angle with a body of the lock plate and a second wing forming a second wing angle with the body of the lock plate, wherein the expansion of the lock plate increases the first and second wing angles.

6. The connector system of claim 5 wherein each connector block further comprises a first chamfer and a second chamfer, the first chamfer operable to bend the first wing and the second chamfer operable to bend the second wing.

7. The connector system of claim 1 wherein the connector block is formed of extruded metal.

8. A connector system for structural members, comprising:

a connector plate defining a plurality of perimeter through holes and a plurality of inner through holes;

a first connector block;

a second connector block;

a first bolt received through one of the plurality of inner through holes and in threaded engagement with the first connector block; and a second bolt received through one of the plurality of perimeter through holes and in threaded engagement with the second connector block;

a first lock plate configured to expand upon being drawn into tight engagement with the first connector block, wherein the expanded lock plate impinges on an internal surface of a structural member; and a second lock plate configured to expand upon being drawn into tight engagement with the second connector block, wherein the expanded lock plate impinges on an internal surface of a structural member.

9. The connector system of claim 8 wherein each of the first and second lock plates comprises a first wing forming a first wing angle with a body of the lock plate and a second wing forming a second wing angle with the body of the lock plate, wherein the expansion of the lock plate increases the first and second wing angles.

10. The connector system of claim 9 wherein each of the first and second connector blocks further comprises a first chamfer and a second chamfer, the first chamfer operable to bend the first wing and the second chamfer operable to bend the second wing.

11. The connector system of claim 8 wherein the first and second connector blocks are formed of extruded metal.

12. The connector system of claim 11 wherein the extruded metal comprises extruded aluminum.

13. A connector system for structural members, comprising:

a connector plate supporting a plurality of connector block assemblies, each connector block assembly, comprising:

a locking screw comprising a screw thread;

a connector block comprising a bore hole sized and shaped to receive the locking screw, the connector block configured to engage with a bolt thread of a bolt;

a lock plate having a plate thread configured to engage the screw thread of the locking screw, the lock plate being configured to expand upon being drawn by the locking screw into tight engagement with the connector block; and wherein the expanded lock plate is configured to apply a force to at least one internal wall of a structural member.

14. The connector system of claim 13 wherein each bore hole is sized and shaped to receive a head of the locking screw and a portion of the bore hole is threaded.

15. The connector system of claim 14 wherein the threaded portion of each bore hole is configured to engage the bolt thread of the bolt.

16. The connector system of claim 13 wherein the bolt is received through one of the plurality of through holes in the connector plate.

17. The connector system of claim 13 wherein each lock plate comprises a first wing forming a first wing angle with a body of the lock plate and a second wing forming a second wing angle with the body of the lock plate, wherein the expansion of the lock plate increases the first and second wing angles.

18. The connector system of claim 17 wherein each connector block further comprises a first chamfer and a second chamfer, the first chamfer operable to bend the first wing and the second chamfer operable to bend the second wing.

19. The connector system of claim 13 wherein the first and second connector blocks are formed of extruded metal.

20. The connector system of claim 19 wherein the extruded metal comprises extruded aluminum.

* * * * *